US007004795B2

(12) United States Patent
Mancini et al.

(10) Patent No.: US 7,004,795 B2
(45) Date of Patent: Feb. 28, 2006

(54) POWERPOLE CONNECTOR ASSEMBLY AND METHODS THEREOF

(75) Inventors: Danna A. Mancini, Worcester, MA (US); Craig H. Baker, Shrewsbury, MA (US); Andre G. Beaupre, Barre, MA (US); Urs F. Nager, Hudson, NH (US)

(73) Assignee: Anderson Power Products, Sterling, MA (US)

( * ) Notice: Subject to any disclaimer, the term of this patent is extended or adjusted under 35 U.S.C. 154(b) by 0 days.

(21) Appl. No.: 10/910,392

(22) Filed: Aug. 3, 2004

(65) Prior Publication Data

US 2005/0032436 A1 Feb. 10, 2005

Related U.S. Application Data

(60) Provisional application No. 60/493,422, filed on Aug. 7, 2003.

(51) Int. Cl.
*H01R 13/502* (2006.01)

(52) U.S. Cl. ..... 439/701; 439/717; 439/459; 439/465

(58) Field of Classification Search ..... 439/701, 439/717, 459, 465
See application file for complete search history.

(56) References Cited

U.S. PATENT DOCUMENTS

| | | | | |
|---|---|---|---|---|
| 6,268,564 | B1 * | 7/2001 | Miyakoshi | 174/58 |
| 6,488,546 | B1 * | 12/2002 | Sakurai et al. | 439/701 |
| 6,619,995 | B1 * | 9/2003 | Hayashi et al. | 439/701 |
| 6,619,996 | B1 * | 9/2003 | Hara et al. | 439/701 |
| 6,623,309 | B1 * | 9/2003 | Sakurai et al. | 439/701 |
| 6,645,003 | B1 * | 11/2003 | Yoshida et al. | 439/507 |

* cited by examiner

*Primary Examiner*—Truc Nguyen
(74) *Attorney, Agent, or Firm*—Nixon Peabody LLP

(57) ABSTRACT

A connector assembly includes a housing and at least one connector. The housing which defines a passage with first and second openings and which has at least one inner surface with at least one of a groove. The connector has at least one outer surface with at least one projection. The projection detachably mates with the groove to secure the connector in the passage in the housing adjacent the first opening in one of a variety of configurations.

29 Claims, 12 Drawing Sheets

FRONT VIEW OF HOUSINGS W/O POWERPOLES

SECTION VIEW THROUGH FRONT HALF OF HOUSING SHOWING ALL (12) GROOVES

71(4)
72(2)
72(1)
71(3)
28(10)
28(9)
71(2)
70(2)
71(3)
72(1)
71(3)
71(4)
72(2)
28(9)

72(1)
71(4)
72(2)
71(3)
28(10)
86
28(9)

88
28(10)
71(2)
71(3)
70(2)
72(1)
72(2)
71(3)
71(4)
28(9)

POWERPOLE CONNECTOR ASSEMBLY AND METHODS THEREOF

This application claims the benefit of U.S. Provisional Patent Application Ser. No. 60/493,422 filed Aug. 7, 2003 which is hereby incorporated by reference in its entirety.

FIELD OF THE INVENTION

The present invention relates generally to electrical connectors and, more particularly, to a powerpole connector housing for the packaging of blocked powerpole connectors into a housing which provides positive latching, strain relief, and system grounding.

BACKGROUND

Referring to FIG. 1, an example of making a prior power powerpole connector assembly 10 is illustrated. In this example, an end user must thread the cables 12(1)–12(8) through the housing 14, attach the powerpole connectors 16(1)–16(8) to the ends of each of the cables 12(1)–12(8), and then pull the powerpole connectors 16(1)–16(8) back into the housing 14. Once in the powerpole connectors 16(1)–16(8) are in place in the housing 14, the end user must lock the powerpole connectors 16(1)–16(8) into the housing 14 by pressing retaining pins 18(1)–18(3) through holes 19(1)–19(3) in the housing 14 and holes 17(1)–17(3) in the powerpole connectors 16(1)–16(8). The cables 12(1)–12(8) are then secured in place by a cable clamp 15.

Unfortunately, there are a number of shortcomings to this method of making and design of the powerpole connector assembly 10. As the discussion above illustrates, the process for making this powerpole connector assembly 10 is very labor intensive and time consuming. For example, it can be difficult for the end user to train cables 12(1)–12(8), particularly larger sized cables, through the housing 14 to be connected to the powerpole connectors 16(1)–16(8). Additionally, it can be difficult for the end user to align the holes 19(1)–19(3) in the housing 14 with the holes 17(1)–17(3) in the block of powerpole connectors 16(1)–16(8) to insert the retaining pins 18(1)–18(3). These and other factors make the assembly of this device difficult and expensive.

In addition to the difficulties in making the powerpole connector assembly 10, the components used in making the powerpole connector housing 14 can also be difficult to manufacture. In particular, the holes 19(1)–19(3) in the housing 14 used to locate the retaining pins 18(1)–18(3) are very close to the edge of the housing 14 and to each other and thus are difficult to manufacture. Precise control of the molding process must be maintained, otherwise cracks and non-filled areas appear around the holes 19(1)–19(3) which can weaken the housing 14. This also adds to the overall cost to manufacture this types of prior powerpole connector assembly 10.

SUMMARY OF THE INVENTION

A connector assembly in accordance with embodiments of the present invention includes a housing and at least one connector. The housing defines a passage with first and second openings and with at least one inner surface with at least one groove. The connector has at least one outer surface with at least one projection. The projection detachably mates with the groove to secure the connector in the passage in the housing adjacent the first opening.

A method for making a connector assembly in accordance with embodiments of the present invention includes providing a housing which defines a passage with first and second openings and which has at least one inner surface with at least one of a groove. At least one connector is provided which has at least one outer surface with at least one projection. The projection is detachably mated with the groove to secure the connector in the passage in the housing adjacent the first opening.

A connector assembly housing in accordance with embodiments of the present invention includes a housing which defines a passage with first and second openings and at least one inner surface of the passage with at least one groove for mating with at least one connector with at least one outer surface that has at least one projection.

The present invention provides a powerpole connector assembly that is easier to assemble and maintain then prior powerpole connector assemblies and also provides positive latching, strain relief, and system grounding. The powerpole connectors can easily be attached and secured in the housing in a variety of configurations without the need to align and pass retaining pins through holes in the housing. Additionally, the housing provides enough space for easily training of larger gauge cables though the housing. Further, this powerpole connector assembly is compatible and mateable with existing powerpole connectors.

DETAILED DESCRIPTION

Figure 1:
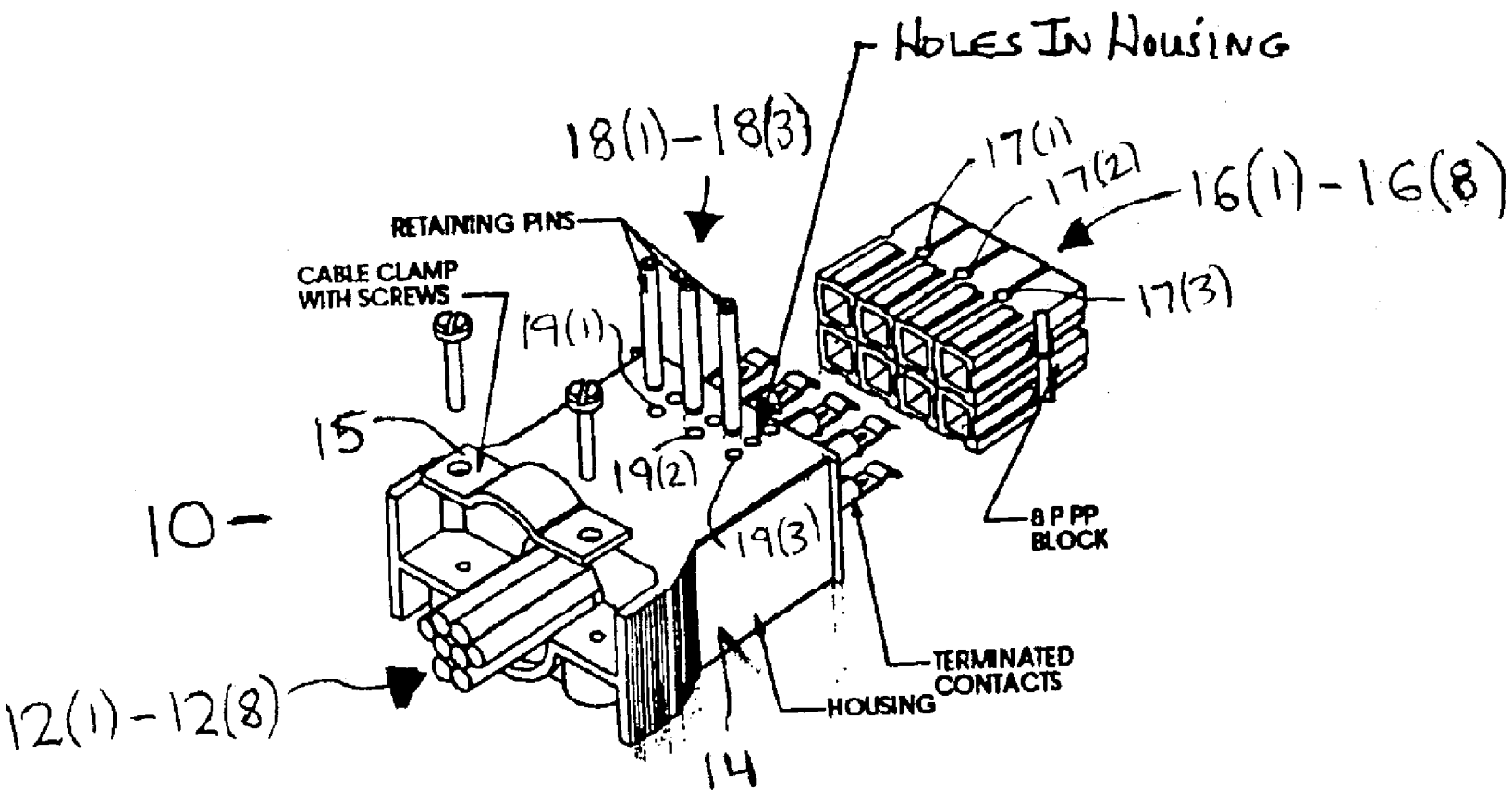
FIG. 1 is a perspective view of an assembly of a prior powerpole connector housing.

A connector assembly 20 in accordance with embodiments of the present invention is illustrated in FIGS. 2–11C. The connector assembly 20 includes a housing 22, a cover 24, and a cable clamp 26 for mating with and retaining connectors 28(1)–28(8), although the connector assembly can comprise other types and numbers of components connected in other manners. The present invention provides a connector assembly 20 that is easy and inexpensive to use and maintain and which also provides positive latching, strain relief, and system grounding.

Referring more specifically to FIGS. 2–5, 7, 8, the housing 22 is a molded plastic component, although other types of materials can be used to make the housing 22, such as metal, depending on the structural and electrical requirements of the application. The housing 22 defines a passage 30 which has first and second openings 32(1) and 32(2), although the housing 22 could have other numbers of passages and openings. The first opening 32(1) of the housing 22 has a substantially rectangular shape which is consistent with the shape of openings in existing connector assemblies and thus can be used with existing connector assemblies, although the opening 32(1) in the housing 22 could have other shapes.

Referring to FIGS. 2–5, 8, and 9, the passage 30 includes inner surfaces 34(1)–34(4) which define a rectangular shape, although the passage 30 could have other numbers of inner surfaces which define other shapes for the passage 30. The inner surface 34(1) has grooves 36(1)–36(4), the inner surface 34(2) has grooves 36(5)–36(6), the inner surface 34(3) has grooves 36(7)–36(10) and the inner surface 34(4) has grooves 36(11)–36(12), although the inner surfaces 34(1)–34(4) each can have other numbers of grooves in other configurations. The grooves 36(1)–36(12) each have a substantially straight shape and are each designed to mate with one of the projections 70(1) or 70(2) on one of the connectors 28(1)–28(8), although one or more of the grooves 34(1)–34(12) could have other shapes in other orientations.

The connectors 28(1)–28(8) are each assembled into a 2×4 configuration with a projection 70(1) or 70(2) of connector 28(1) mated in a groove 72(1) or 72(2) of connector 28(5), a projection 70(1) or 70(2) of connector 28(2) mated in a groove 72(1) or 72(2) of connector 28(6), a projection 70(1) or 70(2) of connector 28(3) mated in a groove 72(1) or 72(2) of connector 28(7), and a projection 70(1) or 70(2) of connector 28(4) mated in a groove 72(1) or 72(2) of connector 28(8), although the connectors 28(1)–28(8) can be mated together in other manners.

Additionally, the connectors 28(1)–28(8) are inserted in the second opening of the passage 32(2) with a projection 70(1) or 70(2) of connector 28(1) slidaby mated in the groove 36(7), a projection 70(1) or 70(2) of connector 28(2) slidaby mated in the groove 36(8), a projection 70(1) or 70(2) of connector 28(3) slidaby mated in the groove 36(9), a projection 70(1) or 70(2) of connector 28(4) slidaby mated in the groove 36(10), a projection 70(1) or 70(2) of connector 28(5) slidaby mated in the groove 36(4), a projection 70(1) or 70(2) of connector 28(6) slidaby mated in the groove 36(3), a projection 70(1) or 70(2) of connector 28(7) slidaby mated in the groove 36(2), a projection 70(1) or 70(2) of connector 28(8) slidaby mated in the groove 36(1), although the connectors 28(1)–28(8) can be mated to one or more of the grooves 36(1)–36(12) of the passage 30 in other manners. The projections 70(1) or 70(2) of the connectors 28(1)–28(8) are slid along the grooves 36(1)–36(4) and 36(7)–36(10) until further slideable movement is not permitted. At this point of restricted movement, the connectors 28(1)–28(8) are mounted in the correct position in the housing 22. Although the projections 70(1) or 70(2) of the connectors 28(1)–28(4) are mated in the grooves 36(7)–36(10) and the projections 70(1) or 70(2) of the connectors 28(5)–28(8) are mated in the grooves 36(1)–36(4), the projections of one or more of the connectors could also be mated in other grooves, such as one or more of the grooves 36(5) and 36(6) in the inner surface 34(2) or one or more of the grooves 34(11) and 34(12) in the inner surface 34(3) of the passage 30. The projections and grooves on each of the connectors 28(1)–28(8) will be described in greater detail below with reference to the connectors 28(1), 28(2), 28(5), and 28(6) shown in FIGS. 10A–10E.

Figure 2:
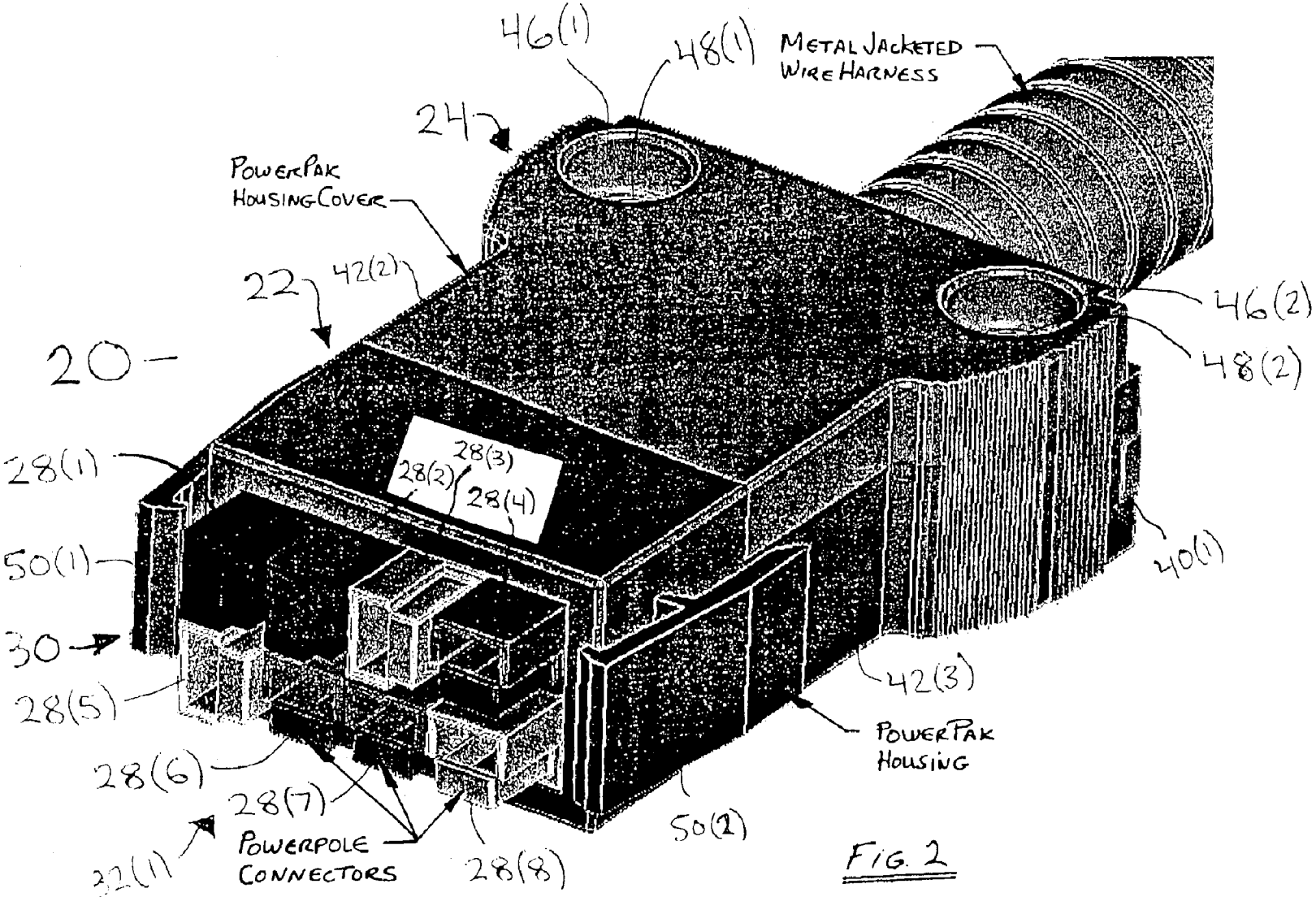
FIG. 2 is a perspective view of one end of a powerpole connector housing in accordance with embodiments of the present invention.
Figure 3:
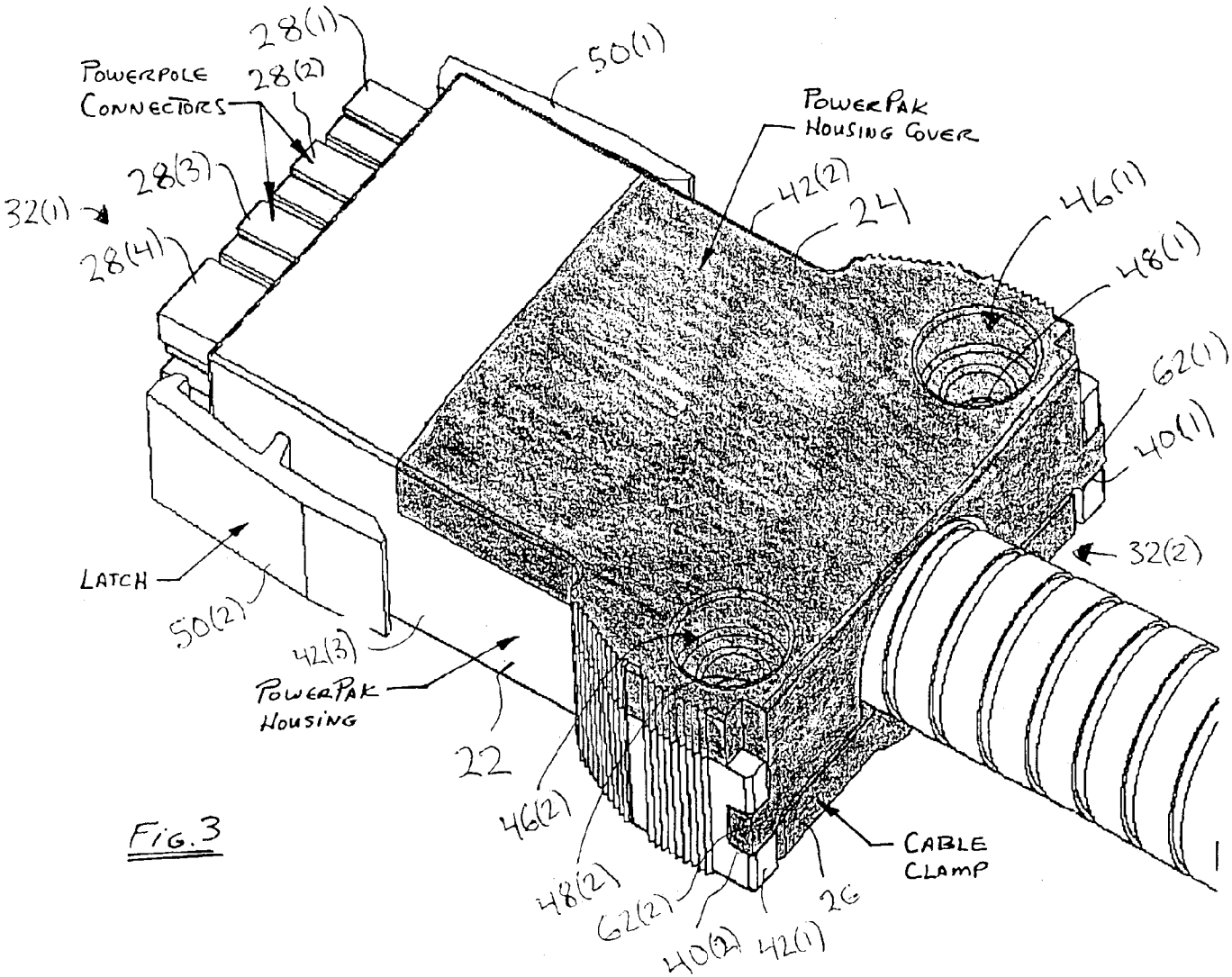
FIG. 3 is a perspective view of another end of the powerpole connector housing shown in FIG. 2.
Figure 4:
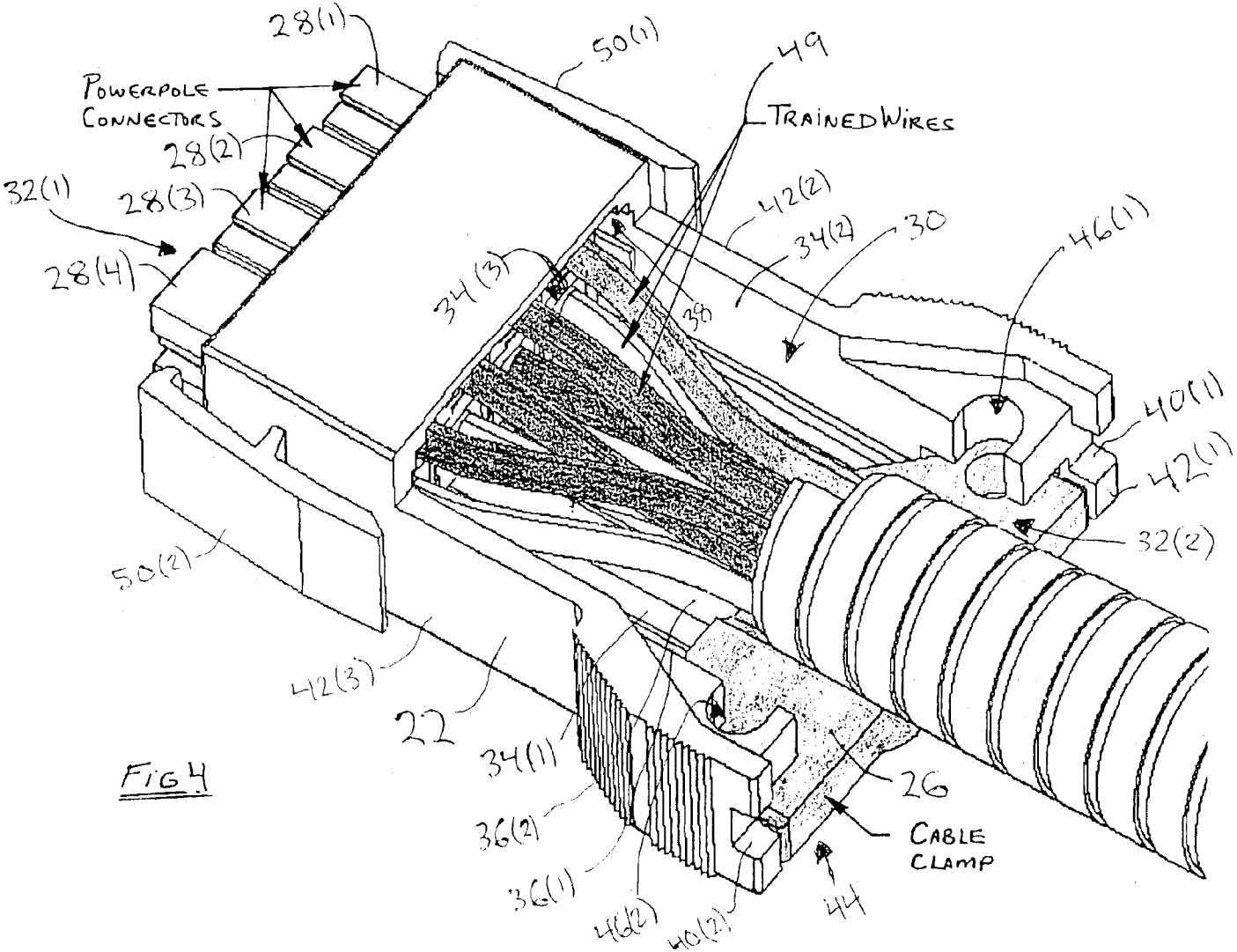
FIG. 4 is a perspective view of the powerpole connector housing shown in FIG. 2 with the cover removed.

As shown in FIGS. 2–4, mating ends of the connectors 28(1)–28(8) are exposed in the first opening 32(1) for mating with connectors in an opening of another connector assembly (not shown), although other numbers of and configurations of mating ends of connectors can be exposed in the first opening 32(1). By way of example only, the first opening 32(1) can be designed for connectors in configurations, such as 2×2, 2×3, 2×4, and 2×5.

Additionally, the mating ends of the connectors 28(1)–28(3) and 28(5) are oriented in a different direction from the mating ends of the connectors 28(4) and 28(6)–28(8) in the first opening 32(1), although one or more of the connectors 28(1)–28(8) could have other orientations. As a result, the connectors 28(1)–28(8) in the opening 32(1) of the housing 22 can be customized to a particular application based on the orientation of the connectors 28(1)–28(8). For example, changing the orientation of one or more of the mating ends of the connectors 28(1)–28(8) can be used to create a key so that the connector assembly 20 only can mate with connectors in an opening of another connector assembly with the same configuration.

Figure 5:
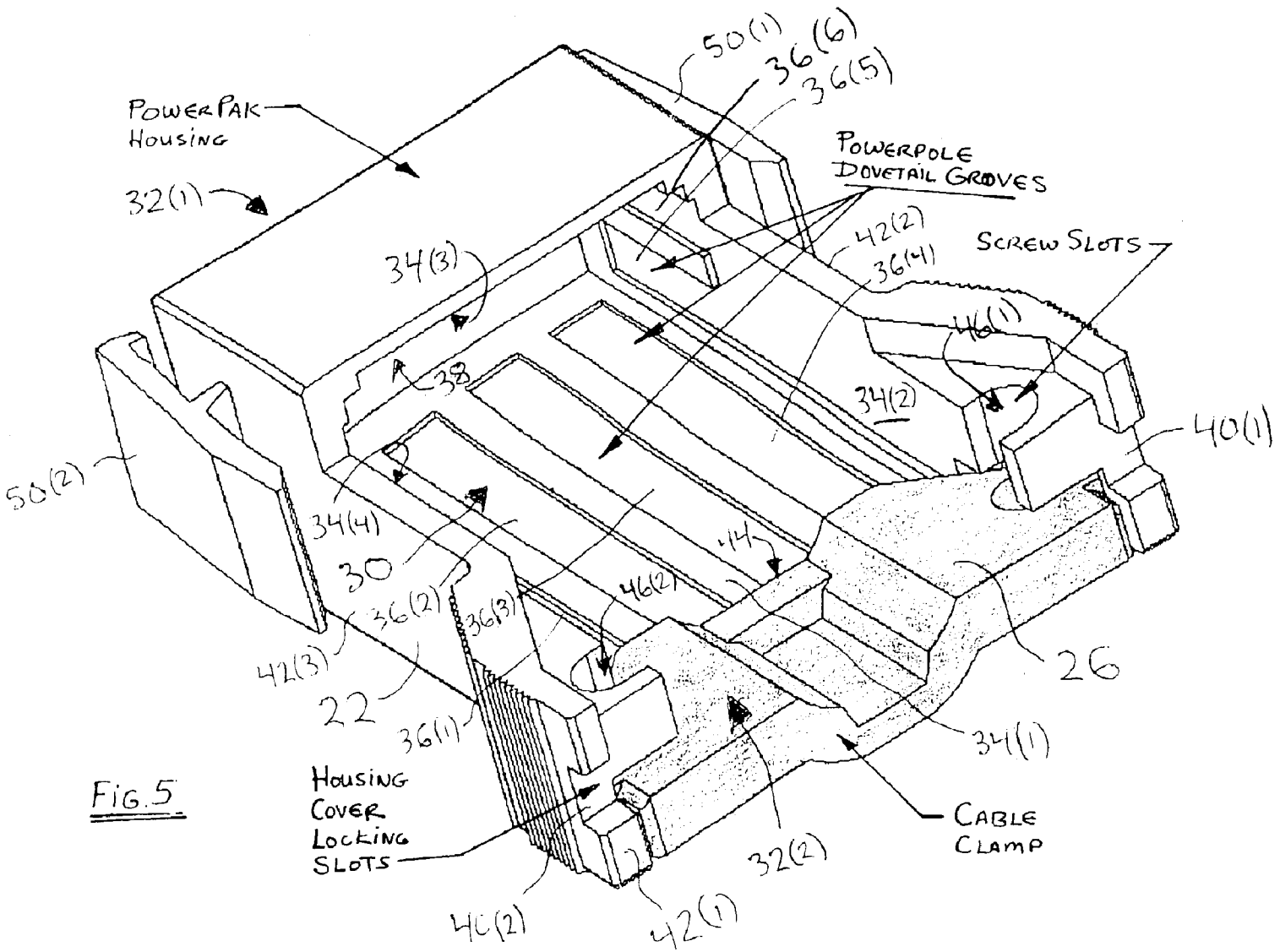
FIG. 5 a perspective view of the powerpole connector housing shown in FIG. 2 with the cover and cable removed to illustrate the screw slots, cover locking slots, and grooves in the housing.

Referring to FIGS. 4–5, the housing 22 also has an indented section 38 along the inner surface 34(3) of the passage 30 facing the second opening 32(2) which is shaped to mate with an edge of the cover 24, although other configurations could be used, such as having a projection extending from the inner surface 34(3) of the passage 30 which mates with an opening in an edge of the cover 24. The housing 22 also has a pair of slots 40(1) and 40(2) on opposing sides of another side 42(1) of the housing 22 for securing the cover 24, although the housing 22 can have other numbers of slots in other configurations.

Referring to FIGS. 2–5, the housing 22 also has a cutout section 44 which includes pockets 52(1) and 52(2) and is shaped to mate with the cable clamp 26 including cable tabs 54(1) and 54(2), although the housing 22 could have other configurations for engaging with the cable clamp 26. The housing 22 has a portion of openings 46(1) and 46(2) which also extend through the cover 24 and cable clamp 26 to permit screws 48(1)–48(2) to pass through and secure the cover 24 and cable clamp 26 together and to the housing 22, although the cover 24 and cable clamp 26 can have other numbers of openings and screws in other configurations and can be secured together in other manners. Securing the cover 24 and cable clamp 26 together and to the housing 22 about the cables 49 or other conductors to provide strain relief.

Referring to FIGS. 2–5, 8, and 9, the housing 22 has a pair of latches 50(1) and 50(2) on opposing sides 42(2) and 42(3), respectively, for locking the housing 22 to another housing of another connector assembly, although the housing 22 can have other numbers of latches and other manners for securing the housing 22 to another housing.

Figure 6:
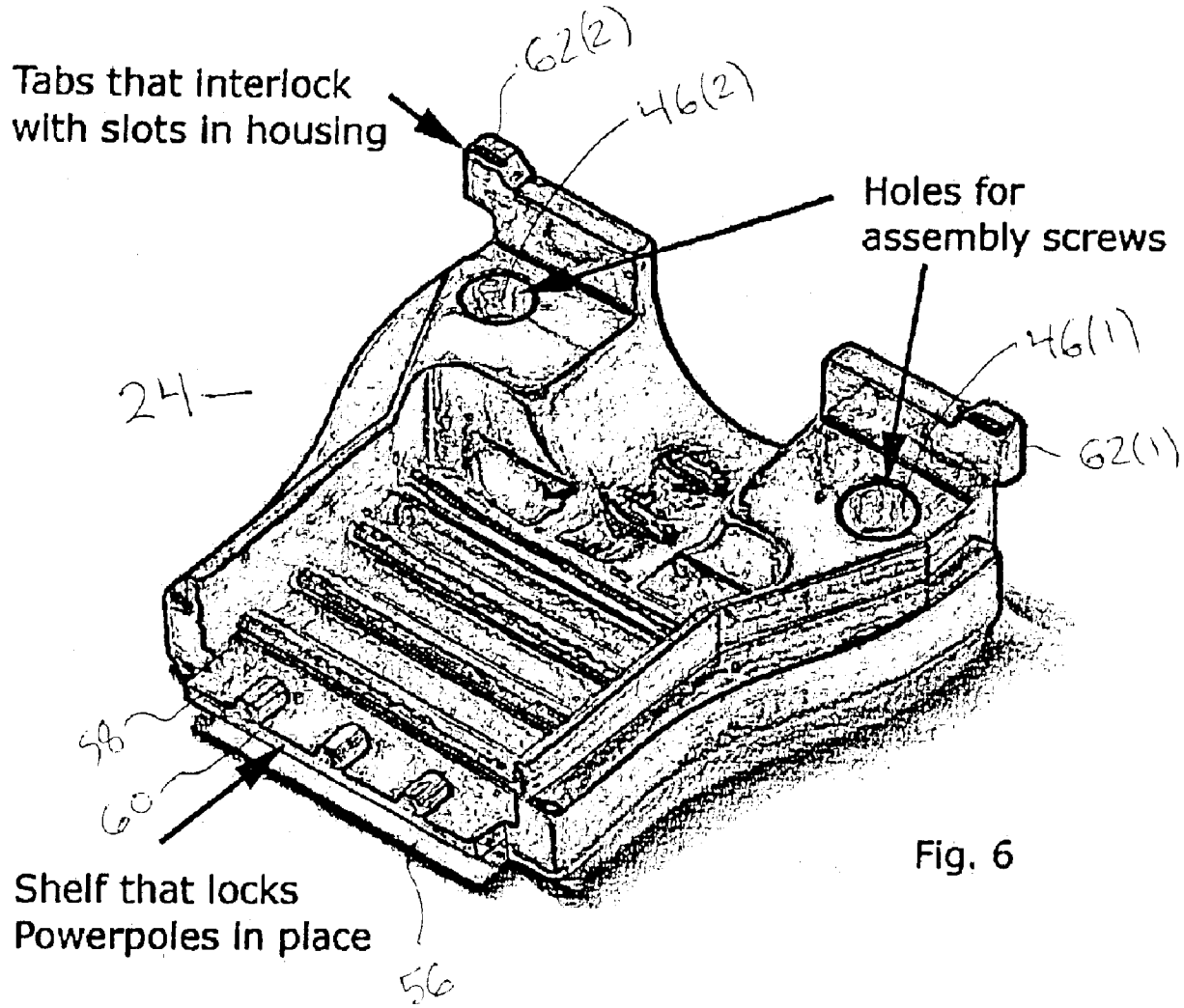
FIG. 6 is a perspective view of the cover for the powerpole connector housing.
Figure 7:
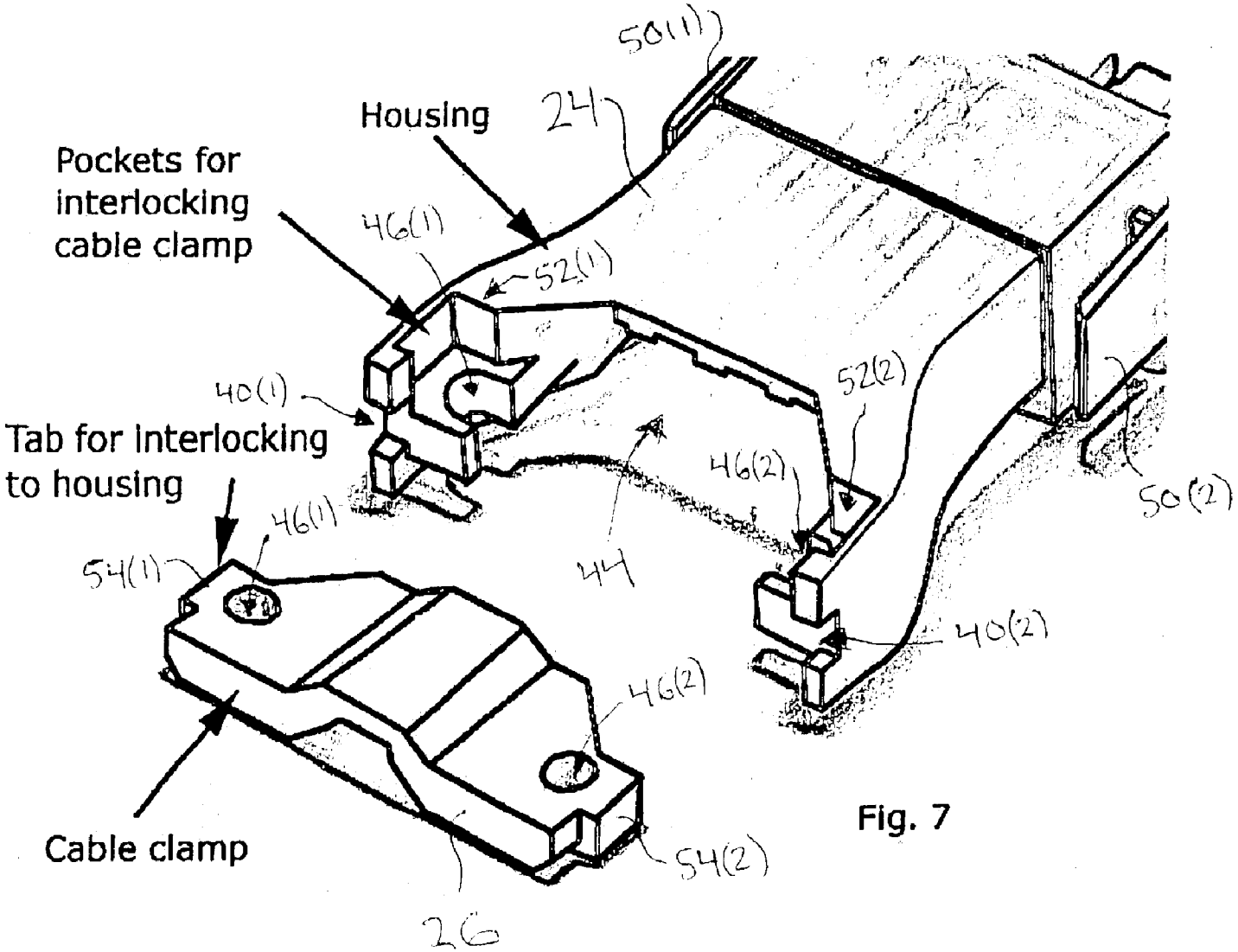
FIG. 7 is a perspective view of the cable clamp detached from the powerpole connector housing.
Figure 8:
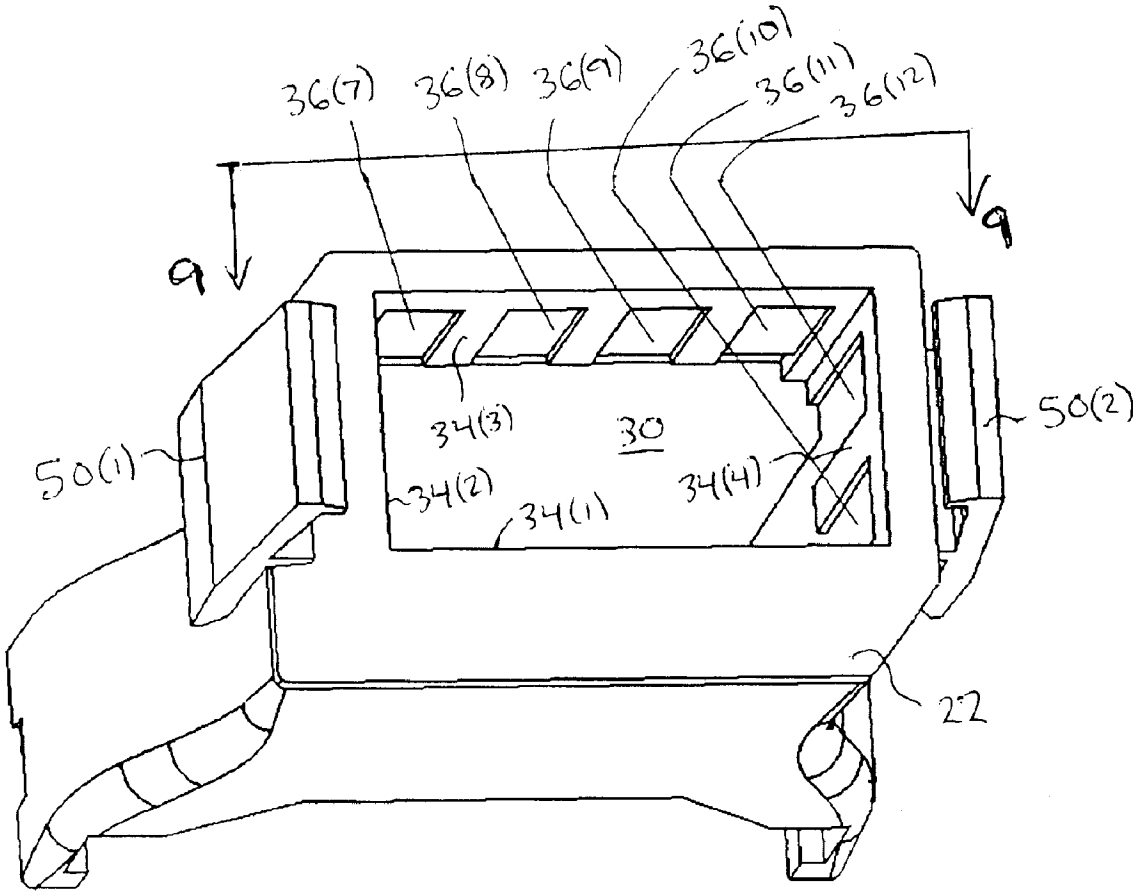
FIG. 8 is a perspective view of one end of the powerpole connector housing with the connectors removed to illustrate groove along the inner surface of the passage.
Figure 9:
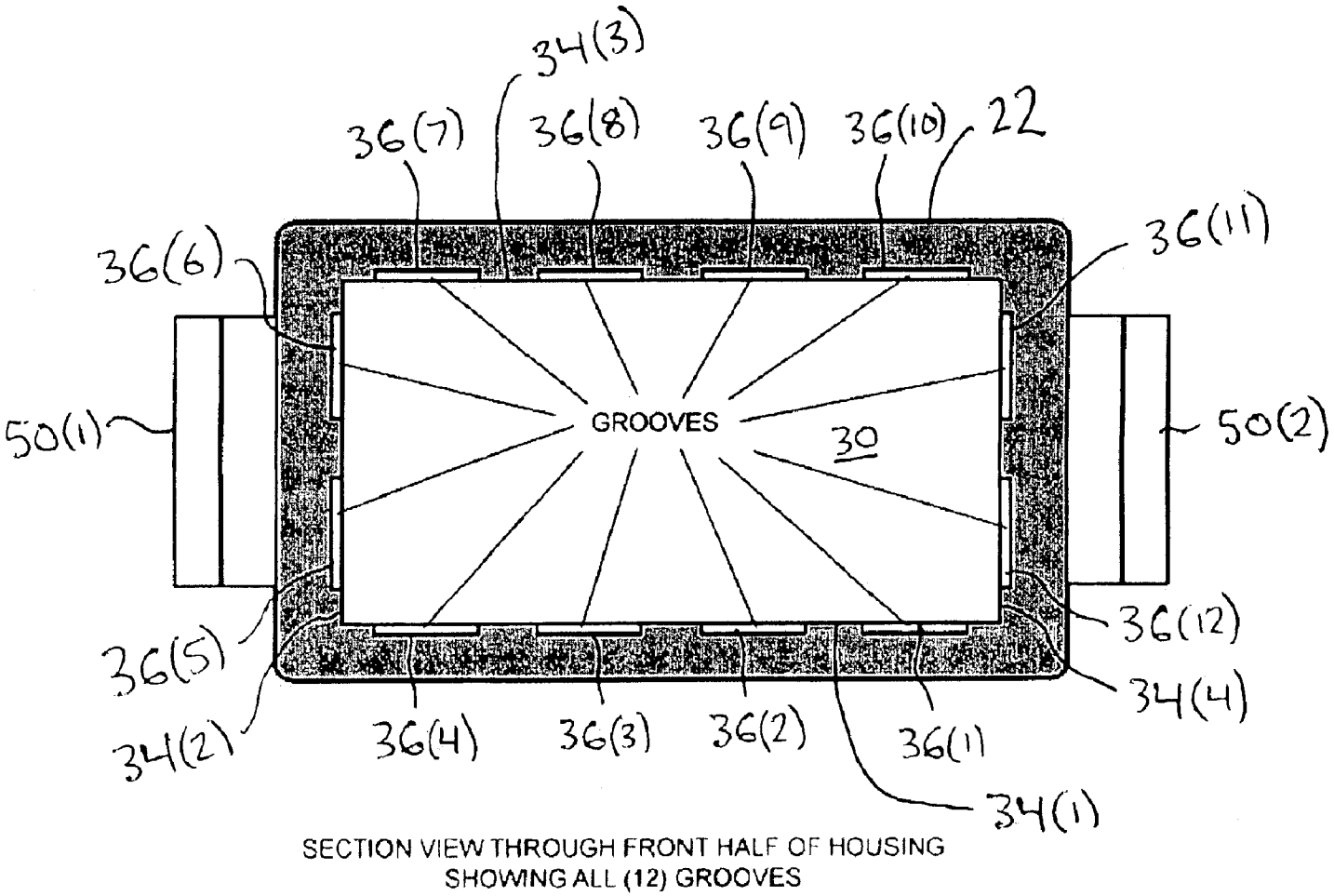
FIG. 9 is a cross-sectional, end view of the powerpole connector housing taken along line 9—9 in FIG. 8.
Figure 10A:
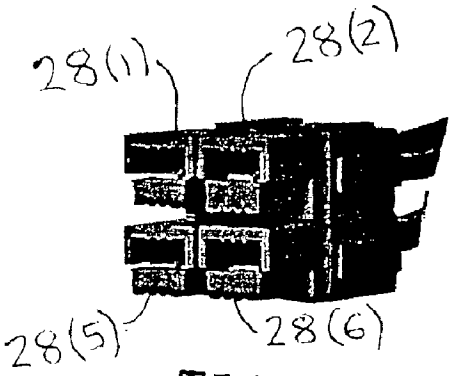
FIG. 10A is a perspective view of a plurality of powerpole connectors coupled to cables.
Figure 10C:
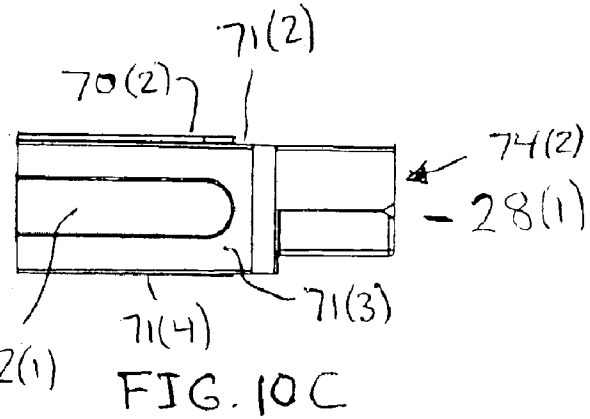
FIG. 10C is a side view of a powerpole connector.
Figure 10B:
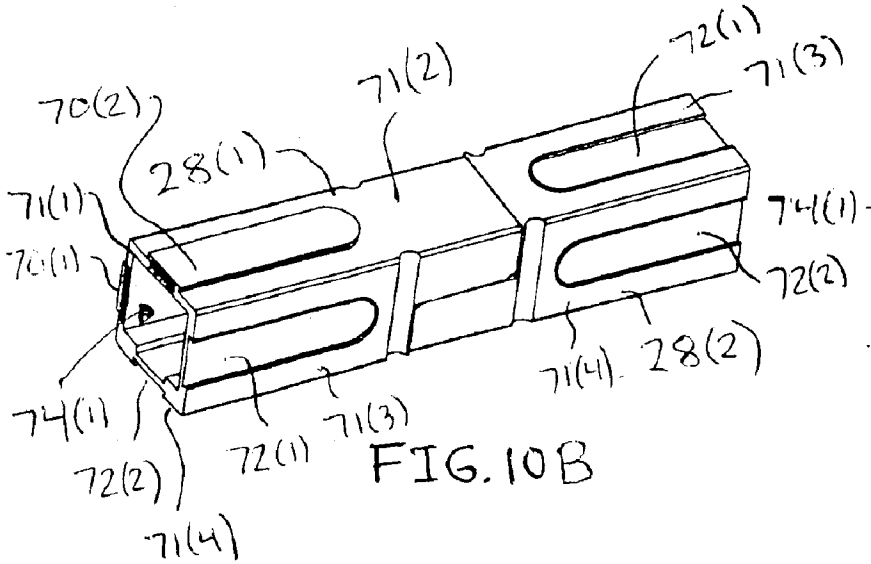
FIG. 10B is a perspective view of a pair of mated power pole connectors.
Figure 10E:
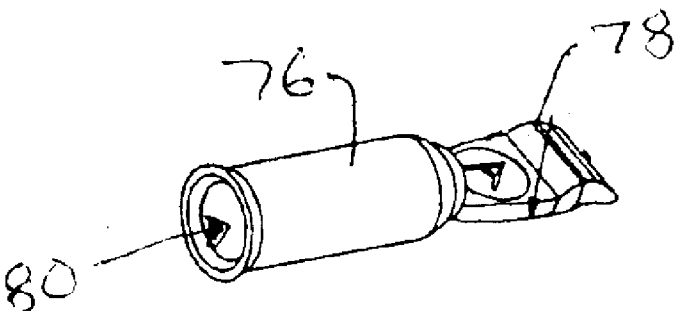
FIG. 10E is a perspective view of a genderless connector used in the powerpole connector shown in FIG. 10C.
Figure 10D:
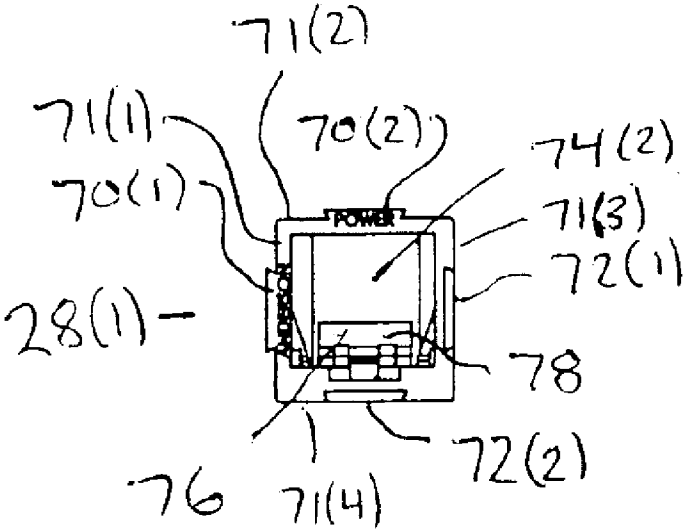
FIG. 10D is an end view of the powerpole connector shown in FIG. 10C.

Referring to FIGS. 2, 3, and 6, the cover 24 is shaped to fit over a portion of the second opening 32(2) of the passage 30 in the housing 22 to enclose and secure the cables 49 and to keep the connectors 28(1)–28(8) from backing out of their mating position in the first opening 32(1) of the housing 22. More specifically, the cover 24 has a lip 56 along one edge 58 which is shaped to mate with an indented section 38 along the inner surface 34(3) of the passage 30 facing the second opening 32(2) in the housing 22, although the edge 58 and the inner surface 34(3) of the passage 30 can have other mating configurations. The edge 58 of the cover 24 also has a shelf 60 which is pressed against an end of the connectors 28(1)–28(4) facing the second opening 32(2) to secure and prevent the projections of the connectors 28(1)–28(8) which are detachably secured in the grooves 36(1)–36(4) and 36(7)–36(10) from sliding backwards towards second opening 32(2). The cover 24 also includes cover tabs 62(1) and 62(2) which are seated in slots 40(1) and 40(2) on opposing sides of another side 42(1) of the housing 22, although the cover 24 can be connected to the housing 22 in other manners. The cover 24 has the openings 46(1) and 46(2) which are used with the screws 48(1) and 48(2) to secure the cover 24 and cable clamp 26 to the housing 22.

The cover 24 is made of a plastic material, although other types of materials can be used for the cover 24, such as metal. If the cover 24 is made of a metallic material, the cover 24 can provide the connector assembly 20 with grounding which may be required for some applications.

Referring to FIGS. 2–5 and 7, the cable clamp 26 is used to secure the cables 49 in the housing 22 and in conjunction with the cover 24 prevents any strain on the cables 49 from unmating the connectors 28(1)–28(8) from their position in the housing 22 adjacent the first opening 32(1). More specifically, the cable clamp 26 is shaped to mate with the cutout section 44 in the housing 22 with the cable clamp tabs 54(1) and 54(2) mating with the pockets 52(1) and 52(2), although the cable clamp 26 can be designed to be secured together with the housing 22 in other manners. The cable clamp 26 has the holes 46(1) and 46(2) for receiving the screws 48(1) and 48(2) for securing the cable clamp 26 and cover 24 to the housing 22.

Referring to FIGS. 10A–10E, connectors 28(1), 28(2), 28(5), and 28(6) are illustrated. Since each of the connectors 28(1)–28(8) is the same in this embodiment, for simplicity of discussion only connector 28(1) is illustrated in detail. The connectors 28(2)–28(8) are the same as connector 28(1) unless otherwise stated herein. The connector 28(1) and connectors 28(2)–28(8) each have a substantially rectangular shape with four outer surfaces 71(1)–71(4) which define a passage with openings 74(1) and 74(2), although the connector 28(1) and connectors 28(2)–28(8) could have other configurations with other numbers of outer surfaces and openings. The connector 28(1) and connectors 28(2)–28(8) each have a projection 70(1) on an outer surface 71 (1), a projection 70(2) on an outer surface 71(2), a groove 72(1) on an outer surface 71(3), and a groove 72(2) on an outer surface 71(4), although each of the connectors 28(1)–28(8) could have other numbers and configurations of projections and grooves on other numbers of outer surfaces. The projections 70(1) and 70(2) on connector 28(1) and the other connectors 28(2)–28(8) are each shaped to mate with a groove on another connector or in one of the grooves 36(1)–36(12) in the passage 30. The grooves 72(1) and 72(2) on connector 28(1)) and the other connectors 28(2)–28(8) are each shaped to mate with a projection 70(1) and 70(2) on another one of the connectors.

The projections 70(1) and 70(2) on each of the connectors 28(1)–28(8) are each dovetail shaped and the grooves 72(1)–72(2) each have a substantially straight shape, although one or more of the projections 70(1) and 70(2) and/or the grooves 72(1)–72(2) could have other shapes in other orientations. As described earlier, with this configuration, one of the projections 70(1) or 70(2) of the connector 28(1)–28(8) can be slid along one of the grooves 36(1)–36(12) in the passage 30 or in one of the grooves 72(1) or 72(2) of another connector until further slideable movement is not permitted. At this point of restricted movement, the connector or connectors is/are mounted in the correct position in the passage 30 in housing 22 or with respect to the other connector(s) before mounting in the passage 30.

A genderless contact 76 is secured within the connector 28(1) with a genderless contact point 78 and an opening 80 to the contact 76 which can be crimped around one of the cables 49. Although a genderless contact 76 is shown, the connector 28(2) can have other configurations.

Figures 11A, 11B, 11C:
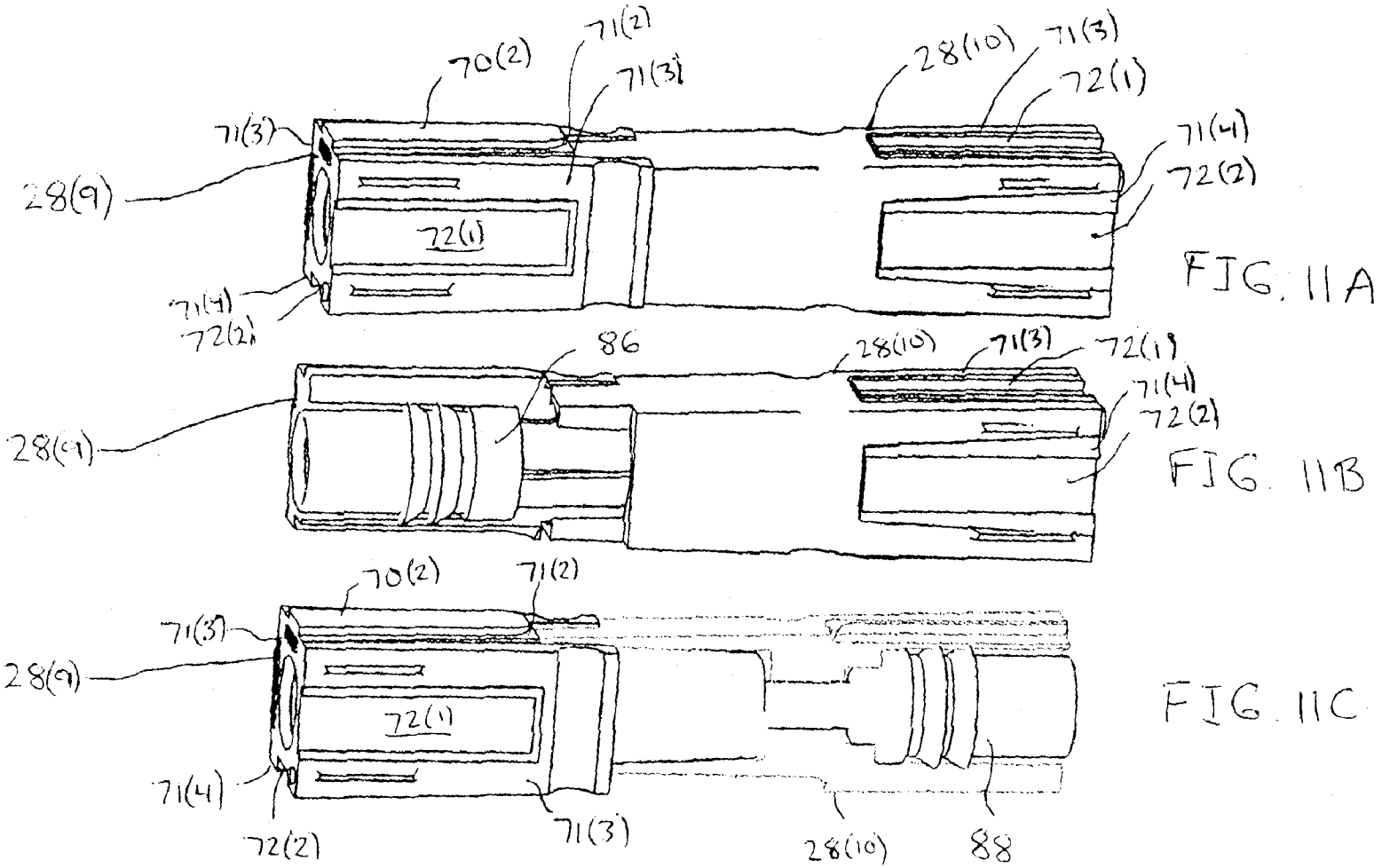
FIG. 11A is a perspective view of a powerpole connector in accordance with other embodiments of the present invention.
FIG. 11B is a perspective view of the powerpole connector shown in FIG. 11A with one end partially broken away to illustrate a portion of the connector.
FIG. 11C is a perspective view of the powerpole connector shown in FIG. 11A with another end partially broken away to illustrate another portion of the connector.

Referring to FIGS. 11A–11C, connectors 28(9) 28(10) are illustrated. The connectors 28(9) and 28(10) are each the same as each of the connectors 28(1)–28(8), except as described herein unless otherwise stated herein. Connectors 28(9) and 28(10) each have four outer surfaces 71(1)–71(4) which define a passage, although each of the connectors 28(9) and 28(10) could have other configurations with other numbers of outer surfaces and openings. The connectors 28(9) and 28(10) each have a projection 70(1) on an outer surface 71(1), a projection 70(2) on an outer surface 71(2), a groove 72(1) on an outer surface 71(3), and a groove 72(2) on an outer surface 71(4), although each of the connectors 28(9) and 28(10) could have other numbers and configurations of projections and grooves on other numbers of outer surfaces. The projections 70(1) and 70(2) on each of the connectors 28(9) and 28(10) are each shaped to mate with a groove on another connector 28(1)–28(10) or in one of the grooves 36(1)–36(12) in the passage 30. The grooves 72(1) and 72(2) on each of the connectors 28(9) and 28(10) are each shaped to mate with a projection.

The projections 70(1) and 70(2) on each of the connectors 28(9)–28(10) are each dovetail shaped and the grooves 72(1)–72(2) each have a substantially straight shape, although one or more of the projections 70(1) and 70(2) and/or the grooves 72(1)–72(2) could have other shapes in other orientations. As described earlier, with this configuration, one of the projections 70(1) or 70(2) of the connector 28(1)–28(10) can be slid along one of the grooves 36(1)–36(12) in the passage 30 or in one of the grooves 72(1) or 72(2) of another connector until further slideable movement is not permitted. At this point of restricted movement, the connector or connectors is/are mounted in the correct position in the passage 30 in housing 22 or with respect to the other connector(s) before mounting in the passage 30.

A female contact 86 is secured within the connector 28(9) and a male contact 88 is secured within the connector 28(10), although the connectors 28(9) and 28(10) could have other configurations. A cable can be coupled to the female contact 86 and the male contact 88. Like the pair of mated power pole connectors shown in FIG. 10B, the connectors 28(9) and 28(10) with their female and male contacts 86 and 88 can be mated together as illustrated in FIGS. 11A–11C.

A method of making a connector assembly 20 in accordance with embodiments of the present invention will now be described with reference to FIGS. 2–11C. The desired configuration for the connectors 28(1)–28(8) can be formed. In this embodiment, the connectors 28(1)–28(8) are secured together to form a 2×4 configuration, although other configurations could be formed and other connectors can be used, such as connectors 28(9) and 28(10). The connectors 28(1)–28(8) are secured together in this configuration by slidably mating the projection 70(1) or 70(2) on one connector with the corresponding groove 72(1) or 72(1) on another one of the connectors. Next, the contacts 76 are crimped around the cables 49 inside the connectors 28(1)–28(8).

The projections of the connectors 28(1)–28(8) are dovetail shaped and are slid in their respective grooves 72(1) or 72(2) until further movement is restricted. The particular orientation of each of the connectors 28(1)–28(8) in the 2×4 configuration can be adjusted as desired.

Next, the projections on the connectors 28(1)–28(4) are slidably mated with the grooves 36(7)–36(10) and connectors 28(5)–28(8) are slidably mated with the grooves 36(1)–36(4) in the passage 30 in the housing 22. More specifically, the projections of the connectors 28(1)–28(8) are dovetail shaped and are slid in the grooves 36(1)–36(4) and 36(7)–36(10) until further movement is restricted. At this point the connectors 28(1)–28(8) are in the correct position in the passage 30 in the housing 22 adjacent the first opening 32(1).

Next, the lip 56 along one edge 58 of the cover 24 is mated with the indented section 38 along the inner surface 34(3) of the passage 30 facing the second opening 32(2) in the housing 22. Mating the lip 56 in the indented section 38 also presses the shelf 60 against an end of the connectors 28(1)–28(4) facing the second opening 32(2). This shelf 60 secures and prevents the projections of the connectors 28(1)–28(8) from sliding backwards towards second opening 32(2). Cover tabs 62(1) and 62(2) of cover 24 are also seated in slots 40(1) and 40(2) on opposing sides of another side 42(1) of the housing 22 and are used to detachable secure the cover 24.

Next, cable clamp 26 is mated with the cutout section 44 in the housing 22 and cable clamp tabs 54(1) and 54(2) are mated in the pockets 52(1) and 52(2). Once the cover 24 and cable clamp 26 are in place, a screw 48(1) is secured in the hole 46(1) which passes through a portion of the cover 24, the housing 22, and the cable clamp 26. Another screw 48(2) is secured in the hole 46(2) which passes through the cover 24, the housing 22, and the cable clamp 26. Securing the cover 24 and the cable clamp 26 to the housing 22 provides strain relief for the cables 49 coupled to the connectors 28(1)–28(8).

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefor, is not intended to limit the claimed processes to any order except as may be specified in the claims. Accordingly, the invention is limited only by the following claims and equivalents thereto.

What is claimed is:

1. A connector assembly comprising:

a housing which defines a passage with first and second openings, the passage having at least one inner surface with at least one groove;

at least one connector with at least one outer surface that has at least one projection, wherein the projection detachably mates with the groove to secure the connector in the passage in the housing adjacent the first opening; and a cover which is shaped to fit over at least a portion of the second opening of the housing; a cable clamp which is shaped to fit over another portion of the second opening of the housing; and a securing system which is used to secure the cover and the cable clamp to each other and to the housing to provide strain relief to a cable coupled to the connector in the housing.

2. The assembly as set forth in claim 1 wherein the housing has a plurality of grooves and has a plurality of the at least one connector, wherein one or more of the connectors is detachably secured in a different orientation from the other connectors in the passage of the housing.

3. The assembly as set forth in claim 2 wherein the passage of the housing has a plurality of inner surfaces and at least two of the inner surfaces have at least one of the grooves.

4. The assembly as set forth in claim 1 wherein the projection each has a dove tail shape, wherein the connector is secured in the housing when further slideable movement of the projection along the groove is prevented.

5. The assembly as set forth in claim 1 wherein the cover further comprises at least one protrusion which engages a portion of the connector in the passage of the housing to secure the mating of the projection in the groove adjacent the first opening.

6. The assembly as set forth in claim 5 wherein the cover further comprises:

at least one edge which has a shape which mates with a portion of the housing adjacent the first opening, the edge having the protrusion; and at least one cover tab which mates with a cover slot in the housing adjacent the second opening.

7. The assembly as set forth in claim 1 wherein at least a portion of the cover is made of a conductive material which is coupled to ground.

8. The assembly as set forth in claim 1 wherein the cable clamp has at least one cable clamp tab which mates with a cable clamp slot in the housing adjacent the second opening.

9. The assembly as set forth in claim 1 wherein the securing system comprises:

at least one opening which extends through the cover, the housing adjacent the second opening and the cable clamp; and a securing device which extends through and is used to secure the cover and the cable clamp to each other and to the housing.

10. The assembly as set forth in claim 1 further comprising at least one latch located on an outer surface of the housing adjacent the first opening.

11. A method for making a connector assembly, the method comprising:

providing a housing which defines a passage with first and second openings, the passage having at least one inner surface with at least one of a groove;

providing at least one connector with at least one outer surface that has at least one projection;

and detachably mating the projection with the groove to secure the connector in the passage in the housing adjacent the first opening;

placing a cover over at least a portion of the second opening of the housing;

placing a cable clamp over another portion of the second opening of the housing; and securing the cover and the cable clamp to each other and to the housing to provide strain relief to a cable coupled to the connector in the housing.

12. The method as set forth in claim 11 wherein the housing has a plurality of grooves and has a plurality of the at least one connector and further comprising securing one or more of the connectors in a different orientation from the other connectors in the passage of the housing.

13. The method as set forth in claim 12 wherein the inner passage of the housing has a plurality of inner surfaces and at least two of the inner surfaces have at least one of the groove.

14. The method as set forth in claim 11 wherein the projection has a dove tail shape, wherein the connector is secured in the housing when further slideable movement to detachably mate the projection along the groove is prevented.

15. The method as set forth in claim 11 wherein the placing a cover further comprises engaging a protrusion on the cover with a portion of the connector in the passage of the housing to secure the mating of the projection in the groove adjacent the first opening.

16. The method as set forth in claim 15 wherein the placing a cover further comprises:

mating at least one edge of the cover with a portion of the housing adjacent the first opening, the edge having the protrusion; and mating at least one cover tab with a cover slot in the housing adjacent the second opening.

17. The method as set forth in claim 11 wherein at least a portion of the cover is made of a conductive material which is coupled to ground.

18. The method as set forth in claim 11 wherein the placing a cable clamp further comprises mating at least one cable clamp tab on the cable clamp with a cable clamp slot in the housing adjacent the second opening.

19. The method as set forth in claim 11 wherein the securing the cover and the cable clamp further comprises:

providing at least one opening which extends through the cover, the housing adjacent the second opening and the cable clamp; and extending a securing device through the opening to secure the cover and the cable clamp to each other and to the housing.

20. The method as set forth in claim 11 further comprising providing at least one latch located on an outer surface of the housing adjacent the first opening.

21. A connector assembly housing comprising:

a housing which defines a passage with first and second openings;

at least one inner surface of the passage having at least one of a groove for mating with at least one connector with at least one outer surface that has at least one projection;

a cover which is shaped to fit over at least a portion of the second opening of the housing;

a cable clamp which is shaped to fit over another portion of the second opening of the housing; and a securing system which is used to secure the cover and the cable clamp to each other and to the housing.

22. The assembly housing as set forth in claim 21 wherein the housing has a plurality of the at least one of the groove.

23. The assembly housing as set forth in claim 22 wherein the inner passage of the housing has a plurality of inner surfaces and at least two of the inner surfaces have at least one of the groove.

24. The assembly housing as set forth in claim 21 wherein the cover further comprises at least one protrusion for engaging a portion of a connector in the passage of the housing for securing a mating of the projection in the groove adjacent the first opening.

25. The assembly housing as set forth in claim 24 wherein the cover further comprises:

at least one edge which has a shape which mates with a portion of the housing adjacent the first opening, the edge having the protrusion; and at least one cover tab which mates with a cover slot in the housing adjacent the second opening.

26. The assembly housing as set forth in claim 21 wherein at least a portion of the cover is made of a conductive material which is coupled to ground.

27. The assembly housing as set forth in claim 21 wherein the cable clamp has at least one cable clamp tab which mates with a cable clamp slot in the housing adjacent the second opening.

28. The assembly housing as set forth in claim 21 wherein the securing system comprises:

at least one opening which extends through the cover, the housing adjacent the second opening and the cable clamp; and a securing device which extends through and is used to secure the cover and the cable clamp to each other and to the housing.

29. The assembly housing as set forth in claim 21 further comprising at least one latch located on an outer surface of the housing adjacent the first opening.

* * * * *